US009610747B2

(12) United States Patent
Cone

(10) Patent No.: US 9,610,747 B2
(45) Date of Patent: Apr. 4, 2017

(54) ADJUSTABLE COMPRESSION SCREW PRESS

(71) Applicant: Conveyor Eng. & Mfg. Co., Cedar Rapids, IA (US)

(72) Inventor: Graig R. Cone, Cedar Rapids, IA (US)

(73) Assignee: Conveyor Eng. & Mfg. Co., Cedar Rapids, IA (US)

( * ) Notice: Subject to any disclaimer, the term of this patent is extended or adjusted under 35 U.S.C. 154(b) by 959 days.

(21) Appl. No.: 13/896,929

(22) Filed: May 17, 2013

(65) Prior Publication Data

US 2013/0312624 A1 Nov. 28, 2013

Related U.S. Application Data

(60) Provisional application No. 61/651,831, filed on May 25, 2012.

(51) Int. Cl.
*B30B 9/12* (2006.01)

(52) U.S. Cl.
CPC ..... *B30B 9/125* (2013.01); *B30B 9/121* (2013.01); *B30B 9/127* (2013.01)

(58) Field of Classification Search
CPC ..... B30B 9/125; B30B 9/127; B30B 9/121; B30B 11/24; B30B 11/246; B30B 15/30
USPC ..... 100/117, 145, 215
See application file for complete search history.

(56) References Cited

U.S. PATENT DOCUMENTS

| | | | | |
|---|---|---|---|---|
| 2,111,915 A * | 3/1938 | MacMillin | B30B 15/30 | 222/447 |
| 3,911,809 A | 10/1975 | Eikenes | | |
| 4,161,911 A * | 7/1979 | Schafer | B30B 9/301 | 100/189 |
| 4,781,564 A * | 11/1988 | Cerrone | B30B 15/0005 | 241/273.2 |
| 4,781,823 A * | 11/1988 | Shinozaki | B01D 29/03 | 100/117 |
| 5,515,776 A * | 5/1996 | Scheucher | B30B 9/121 | 100/112 |
| 5,715,747 A * | 2/1998 | Fedon | A01K 59/04 | 100/117 |
| 6,068,108 A * | 5/2000 | Dudley | B65G 65/46 | 198/550.01 |

* cited by examiner

*Primary Examiner* — Jimmy T Nguyen
(74) *Attorney, Agent, or Firm* — Shuttleworth & Ingersoll, PLC; Brett Papendick

(57) ABSTRACT

A variable compression screw press includes a volume displacing member which overlies the pressure housing feed flight of the screw press. In one embodiment, the volume displacing member is a shroud which may be moved in and out of the intake hopper as desired, without having to disassemble the press. In a second embodiment, the volume displacing member is a hinged gate which can be adjusted to overlie more or less of the pressure housing feed flight. In a third embodiment which may be used in cooperation with either first or second embodiment, the volume within the pressure housing feed flight is partly occupied by block elements removably mounted to the screw flighting of the pressure housing feed flight.

9 Claims, 9 Drawing Sheets

ADJUSTABLE COMPRESSION SCREW PRESS

CROSS REFERENCE

This application claims priority under 35 U.S.C. §119 to non-provisional application Ser. No. 61/651,831 entitled "Adjustable Compression Screw Press" which was filed May 25, 2012. The disclosure of provisional application 61/651,831 is hereby incorporated its entirety.

BACKGROUND

In the processing of bulk materials, including wet fibrous materials, it is often necessary to compress the materials to extract liquids and that is typically done with a screw press, which includes a screw operating within a cylindrical screen housing. As the screw compresses the fibrous materials by compacting them, liquid is expressed through the screen housing of the screw press. Each flight (360 degree wrap of flighting) of a screw can hold a certain volume of material as determined by its inner and outer diameter as well as its pitch (length). The compression ratio of the screw press is determined by dividing the volume of the flight entering the screen housing by the volume of the flight leaving the screw housing on the other side. In the compression of wet corn fiber materials, it is desirable to use an optimum compression ratio between one which results in escape of fibrous solids through the screen housing and a smaller compression ratio which results in too little liquid being extracted. Because compressed fibrous materials must be dried, remaining liquids must be removed through evaporation accomplished thermally by use of rotary dryers. Because it is far more enemy efficient to remove liquid mechanically through use of a screw press than thermally in a dryer, it is important to maximize compression without exceeding the limit which results in solids being forced through the cage structure. Generally, in the processing of wet corn fiber material, a nominally approximate compression ratio is 7.5 but materials vary and so use of that ratio may not be optimum for each processing site or each batch of material to be dewatered. However, varying the compression ratio of a screw press has heretofore only been accomplished by alteration of the pitch of the screw flighting at either the intake end or the outlet end, which necessarily requires disassembly of the screw press and reworking of the screw flighting. This is both time consuming and costly yet still typically yields only compromised results.

A need exists for an apparatus which allows variation in the compression ratio of a screw press without the need to alter the pitch of the screw on the intake end; preferably while the press is in operation

SUMMARY OF THE INVENTION

The invention comprises apparatus which effectively reduces the pitch of the pressure housing, feed flight thus changing its volume. The pressure housing feed flight is the screw flight entrance into the screw housing. A volume reduction member is placed within the intake hopper of the screw press to serve to reduce the intake volume of the pressure housing feed flight. The volume reduction member has a lower end which conforms to the periphery of the screw flighting such that the flighting may operate below the lower end while the volume reduction member restricts the intake volume into the pressure housing feed flight.

In one embodiment, a plate hinged at its top is inserted into the intake hopper. By altering the angle and location of the plate, the intake volume may be increased or lowered and the compression ratio thereby changed as needed without disassembling the screw press or even shutting it down temporarily.

In another embodiment, a shroud member is introduced into the intake hopper. The shroud member is adjustable within the intake hopper and may be moved forward into the hopper or moved rearward within the hopper to increase the volume of the intake hopper and thereby increase the compression ratio of the screw press. The shroud member is movable along side rails mounted within the intake hopper and can be moved ahead or back by use of a threaded rod which passes through an end wall of the intake hopper. By properly rotating the threaded rod, the shroud member is moved into or out of the intake volume of the intake hopper of the screw press.

In another embodiment which may be used alone or with the shroud member, block elements are mounted to the screw flighting within the intake hopper to reduce the volume of commodity which may be received in the pressure housing, feed flight, thereby reducing the compression ratio between intake and output of the compression screw press.

It is therefore an objective to provide a variable compression screw press which can be adjusted to vary the compression ratio between the intake hopper of the press and the discharge box of the press by altering the intake volume available to receive commodity at the intake hopper.

Another object of the invention is to provide a screw press which allows the effective pitch of the pressure housing feed flight to be reduced as desired without dismantling the screw press or disrupting its operation.

A further object of the invention is to provide apparatus to further reduce the compression ratio of a screw press by installation of volume displacing block elements on the pressure housing feed flight of the press.

The objects of the invention will be better understood by reference to the detailed description which follows.

DETAILED DESCRIPTION

Definitions: For purposes of the disclosure and claims which follow, the following definitions shall apply:

"Flight" shall mean one segment of screw flighting which consists of 360 degrees of the screw flighting.

"Pitch" shall mean the length along the screw pipe which a single flight extends.

Figure 1:
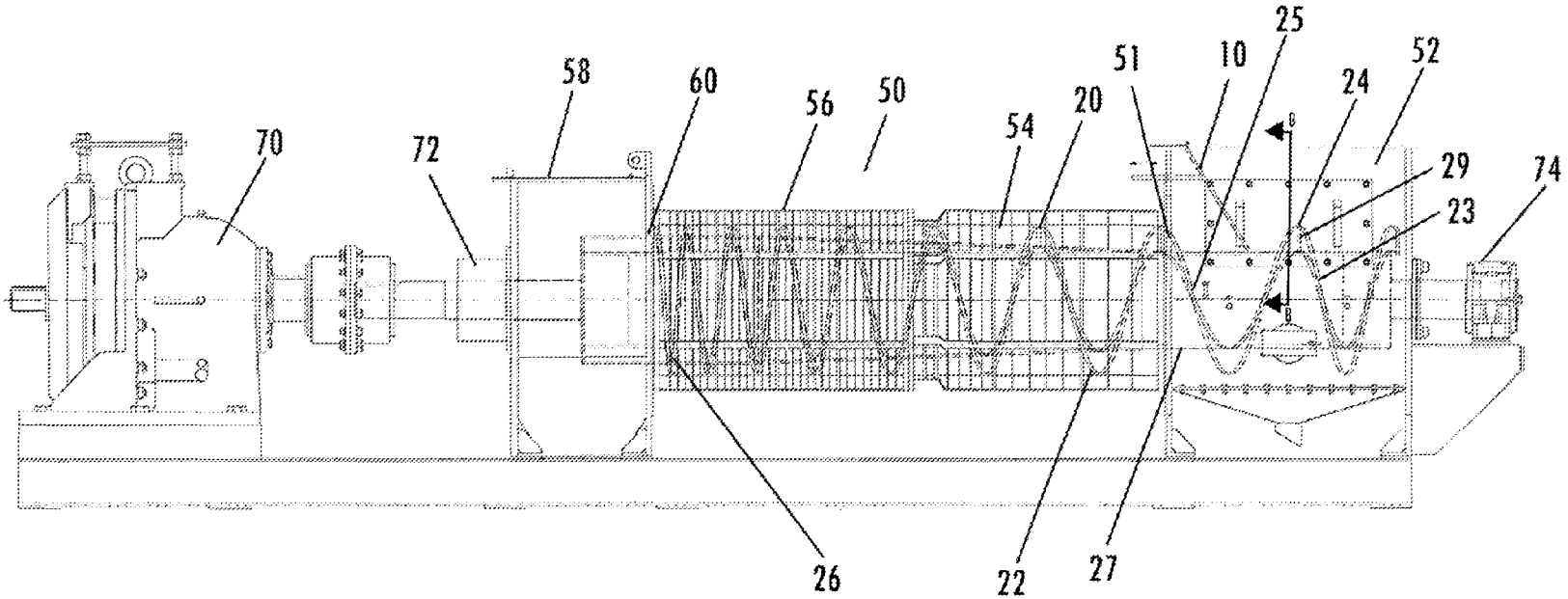
FIG. 1 is a front elevation, partly in section, of a variable compression ratio screw press according to the invention.

FIG. 1 illustrates a screw press 50 equipped with the variable gate 10 of a first embodiment of the invention installed, in the intake hopper 52 of the screw press 50. Screw press 50 also includes a cylindrical screen housing 54 encasing the screw 20, a cage 56 surrounding the screen housing 54 to support it, and a discharge box 58. Helical screw 20 featuring flighting 22 mounted to pipe 27 is installed within screen housing 54. Flighting 22 narrows in pitch between intake hopper 52 and outlet 60. The outer diameter of the flighting 22 remains fixed while the pitch of flighting 22 decreases as the diameter of pipe 27 increases along the length of the screw 20 between intake hopper 52 and discharge box 58. Screw 20 is driven by motor 70 and is supported by end bearings 72, 74. It should be noted that in another common apparatus the diameter of pipe 27 of screw 20 remains constant throughout the length of screw 20 while the diameter of screw flighting 22 tapers downward, which is the opposite of what is shown in FIG. 1. The result of the alternative is the same because the remaining constant is that flighting pitch decreases between intake hopper 52 and final compression flight 26.

Screw flighting 22 includes intake flight 25 which is located within intake hopper 52 immediately adjacent entrance 51 to screen housing 54.

Intake hopper 52 provides a chute through which fibrous commodity is fed to screw 20. The pitch of intake flight 25 located within intake hopper 52, in relationship to the pitch of the final compression flight 26 near outlet 60, governs the compression ratio of the press 50. Intake flight 25 also may be referred to as pressure housing feed flight 25. All flights helically circumnavigate pipe 27 and are fixed in place thereon, typically by welding. Upstream end flight 23 is joined to upstream end 24 of intake flight 25 by a weld 29.

Depending on the nature of the material to be pressed, a preferred approximate compression ratio is determined. For instance, if wet corn fiber is to be compressed, a compression ratio of approximately 7.5 is often used but variations in condition of the material may require that the ratio be different in order to maximize the separation of liquid content front the material without applying so much compressive force that the solids in the material are forced through the screen housing 54. Lower moisture solids require less energy to finish the drying process than wetter solids so maximizing liquid separation is desired before solids are moved to a thermal dryer. The present invention allows selection of varying compression ratios without reworking the pitch of any flights.

Figure 2:
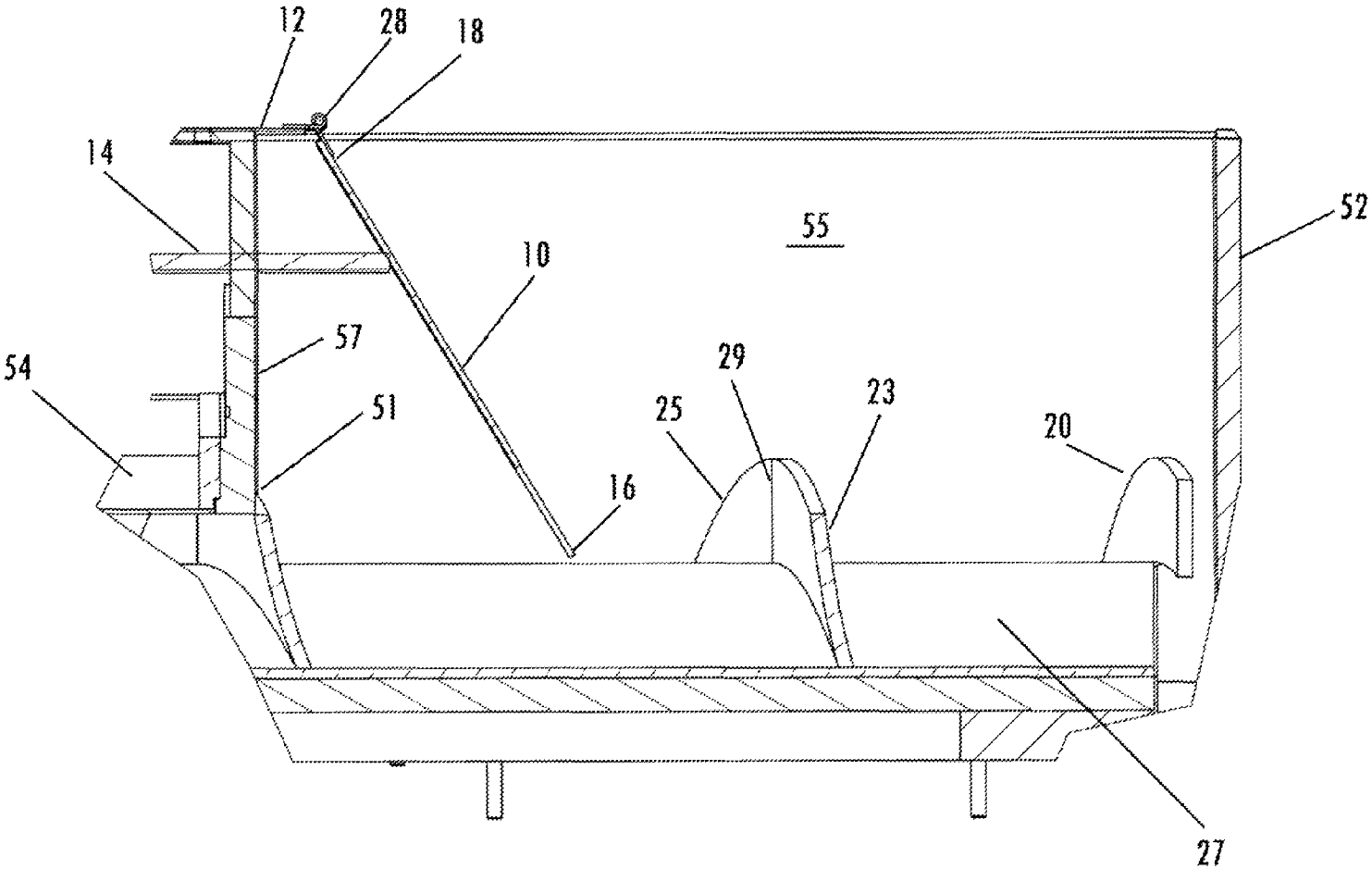
FIG. 2 is an enlarged cross section of the intake hopper of the screw press of showing the adjustable gate embodiment of the invention.
Figure 3:
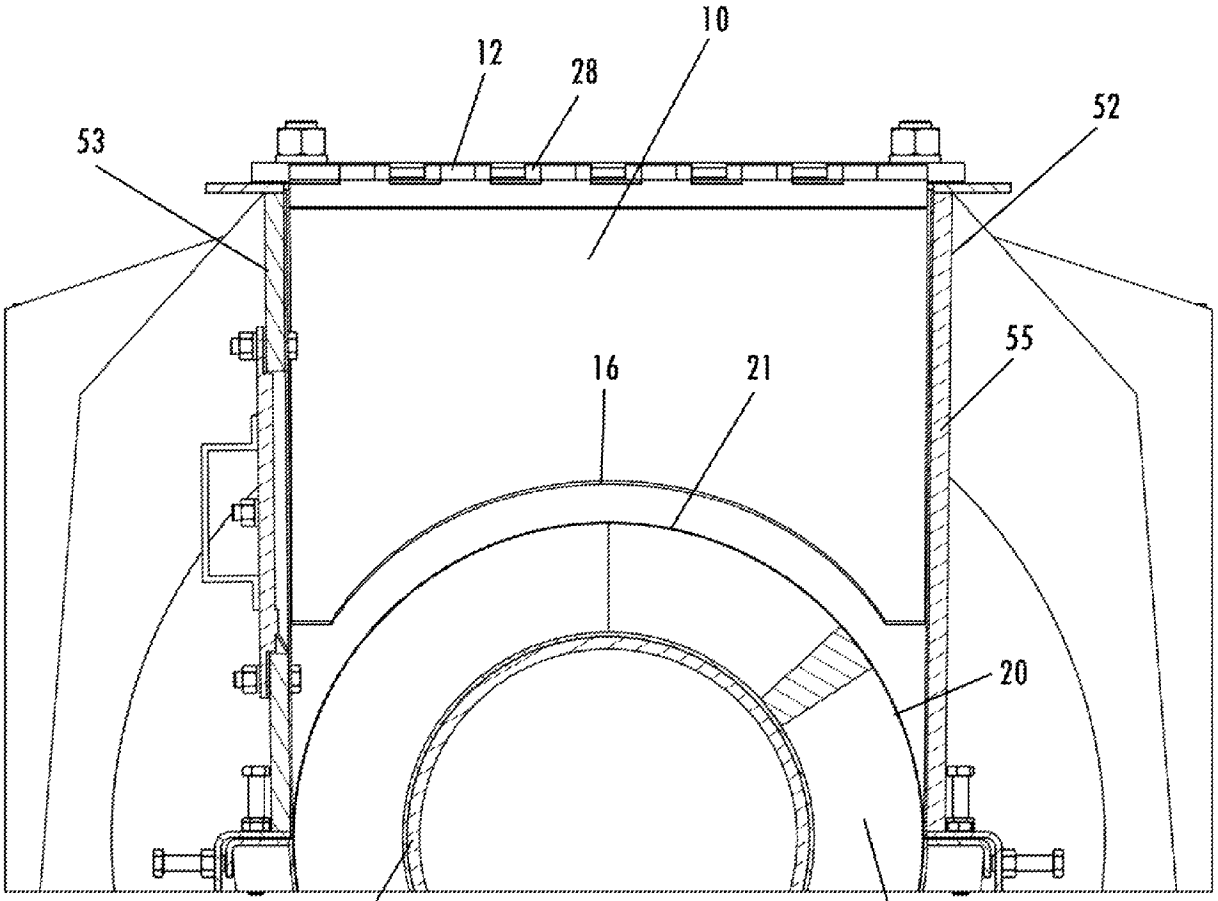
FIG. 3 is an enlarged end view in section of the intake hopper and upper portion of the screw taken along lines B-B of FIG. 1.
Figure 4:
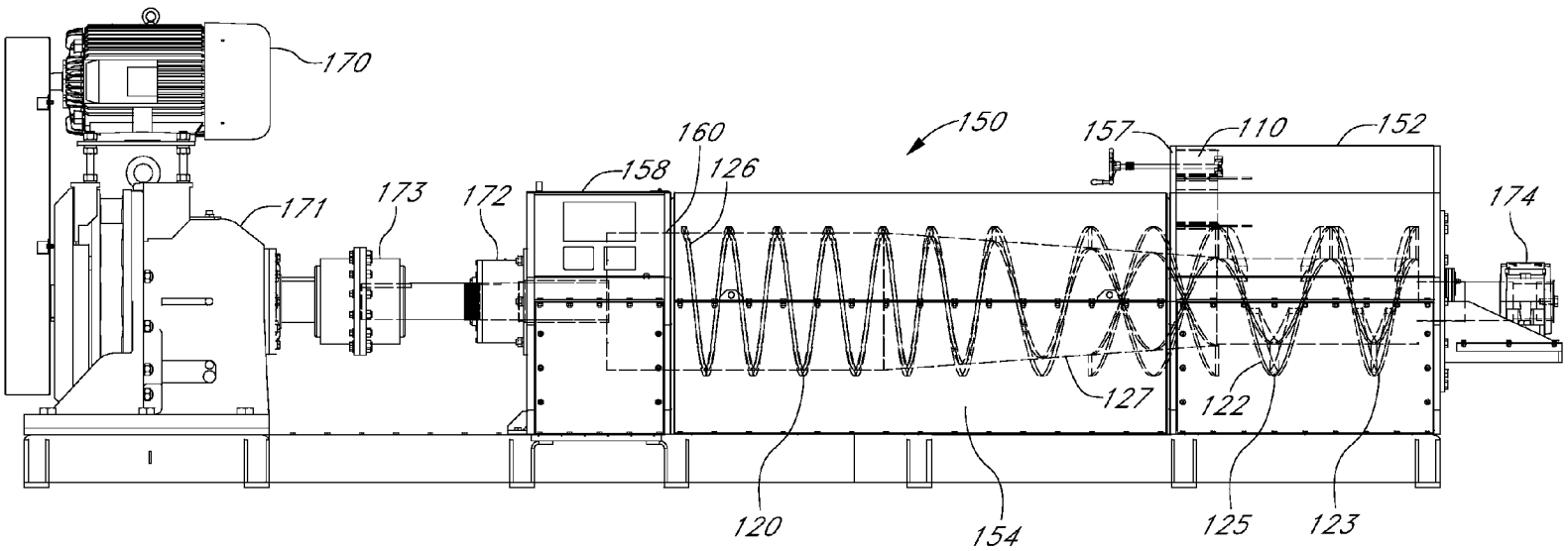
FIG. 4 is a front elevation, partly in section of a variable compression ratio press according to a second preferred embodiment of the invention.

Referring now additionally to FIGS. 2 and 3, the gate 10 of the first embodiment of the invention can be observed. Gate 10 is a planar plate hinged to a shield 12 mounted to downstream end wall 57 of intake hopper 52. Shield 12 overlies a portion of intake flight 25 and the overlain portion may be adjusted as desired. Because of hinge 28 from which gate 10 depends, the incline of gate 10 over screw 20 can be varied. Shield 12 may be moved laterally so that hinged upper end 18 of gate 10 may be moved to a selected position over intake flight 25 to better conform lower edge 16 of gate 10 to the periphery 21 of the screw 20. A control rod 14 may be used to selectively set the incline and span of gate 10. The spacing between arched lower end 16 of gate 10 and intake flight 25 controls the effective feed volume for the screw press 50 and that determines the compression ratio of the press 50. Without gate 10 being in place, the effective feed volume of press 50 is the full volume of intake flight 25 between upstem end 24 thereof and entrance 51 to screen housing 54.

Gate 10 extends between first sidewall 53 and opposing second sidewall 55 of intake hopper 52. Its lower arched end 16 generally conforms to the circular periphery 21 of flighting 22 and is disposed over flight 25. Adjusting rod 14 extends through downstream end wall 57 of intake hopper 52 and is longitudinally moveable to change the angle of gate 10 to restrict more or less of the material volume flowing into flight 25. Other structures to vary the incline and span of gate 10 may be used.

The location of lower end 16 over flight 25 defines the effective feed area. Covering more of flight 25 with gate 10 decreases the compression ratio of press 50.

Therefore, it can be appreciated that variation of the compression ratio of screw press 50 can be controlled by insertion or withdrawal of control rod 14 through downstream end wall 57 and by selective horizontal positioning of shield 12, thereby moving hinge 28 and the upper end 18 of gate 10.

FIGS. 4-7 illustrate an alternative preferred embodiment screw press 150 equipped with a volume displacing shroud member 110 installed in the intake hopper 152 of the screw press 150. Screw press 150 also includes a cylindrical screen housing 154 encasing the screw 120, and a discharge box 158. Helical screw 120 includes flighting 122 which is helically mounted to pipe 127. Screw 120 extends through screen housing 154 and also through tubular screw tube 128 and into intake hopper 152. Flighting 122 of screw 120 narrows in pitch between pressure housing feed flight 125 and final compression flight 126. The outer diameter of the flighting 122 remains fixed while the pitch of flighting 122 decreases as the diameter of pipe 127 increases along the length of the screw 120 between intake hopper 152 and discharge box 158. Screw 120 is driven by motor 170 through gear box 171 which couples by coupler 173 of screw press 150. Screw 120 is supported by end bearings 172, 174.

Screw flighting 122 includes pressure housing feed flight 125 which is located within intake hopper 152 immediately adjacent the free end 130 of screw tube 128 which is located upstream from entrance 151 to screen housing 54. The downstream end 129 of pressure housing feed flight 125 terminates at the free end 128 of screw tube 130.

Intake hopper 152 receives commodity which is intended to be compressed, including fibrous commodity to be fed to screw 120. The pitch of pressure housing feed flight 125 located within intake hopper 152, in relationship to the pitch of the final compression flight 126 near outlet 160, governs the compression ratio of the press 150. All flights of screw 120 helically circumnavigate pipe 127 and are fixed in place thereon, typically by welding. Upstream end flight 123 is joined to pressure housing feed flight 125 and the upstream end 131 thereof.

Depending on the nature and condition of the material to be pressed, a preferred approximate compression ratio is determined. For instance, variations in condition of the material may require that the ratio be somewhat altered in order to maximize the separation of liquid content from the material without applying so much compressive force that the solids in the material are forced through the screen housing 54. The preferred embodiment of FIGS. 4-8 allows selection of varying compression ratios without reworking the pitch of any flights.

The location of bottom end 117 of front wall 114 of shroud member 110 over pressure housing feed flight 125 defines the effective feed area. Covering more of pressure housing feed flight 125 with shroud 110 decreases the compression ratio of press 150.

Therefore, it can be appreciated that variation of the compression ratio of screw press 150 can be controlled by insertion or withdrawal of control rod 14 through downstream end wall 57 and by selective horizontal positioning of shroud member 110.

Referring, now particularly to FIGS. 5A, 5B, 6 and 7, volume displacing shroud member 110 is installed in intake hopper 152 of the screw press 150. The volume displacing shroud member 110 is movable over a range within the intake hopper 152 and is adjustably positioned over the pressure housing feed flight 125 such that the volume displacing member 110 may obstruct none of the space over the pressure housing feed flight 125 or it may be moved further into the intake hopper 152 to obstruct a substantial portion of the space above the pressure housing feed flight 125. Obstruction of some of the space above the pressure housing feed flight 125 effectively limits the quantity of fibrous commodity which may fall into the pressure housing feed flight 125 which effectively reduces the compression ratio of the screw press 150.

Figure 5A:
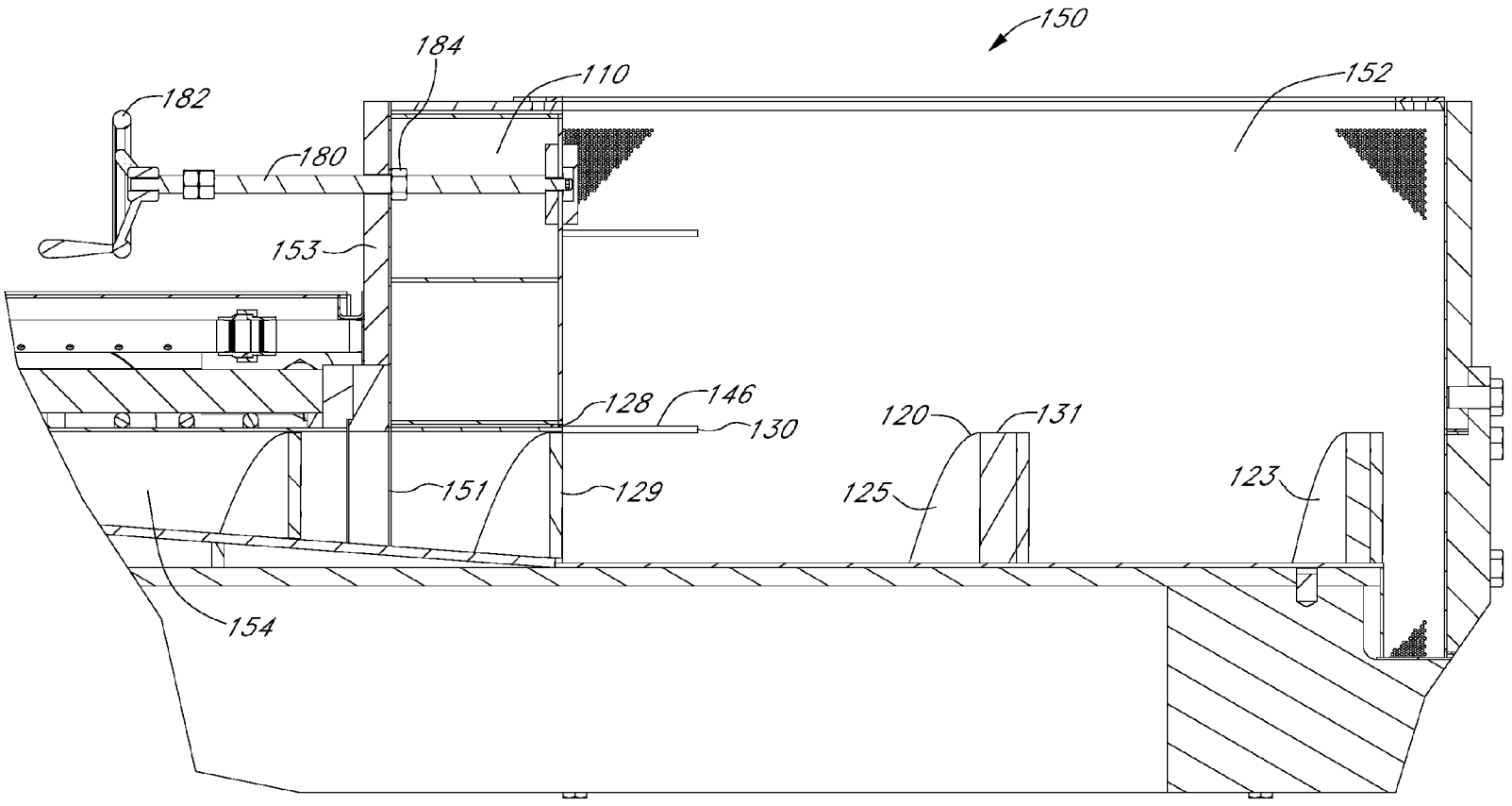
FIG. 5A is an enlarged cross section of the intake hopper of the screw press of FIG. 4 showing the movable shroud member of the invention in its retracted position.
Figure 5B:
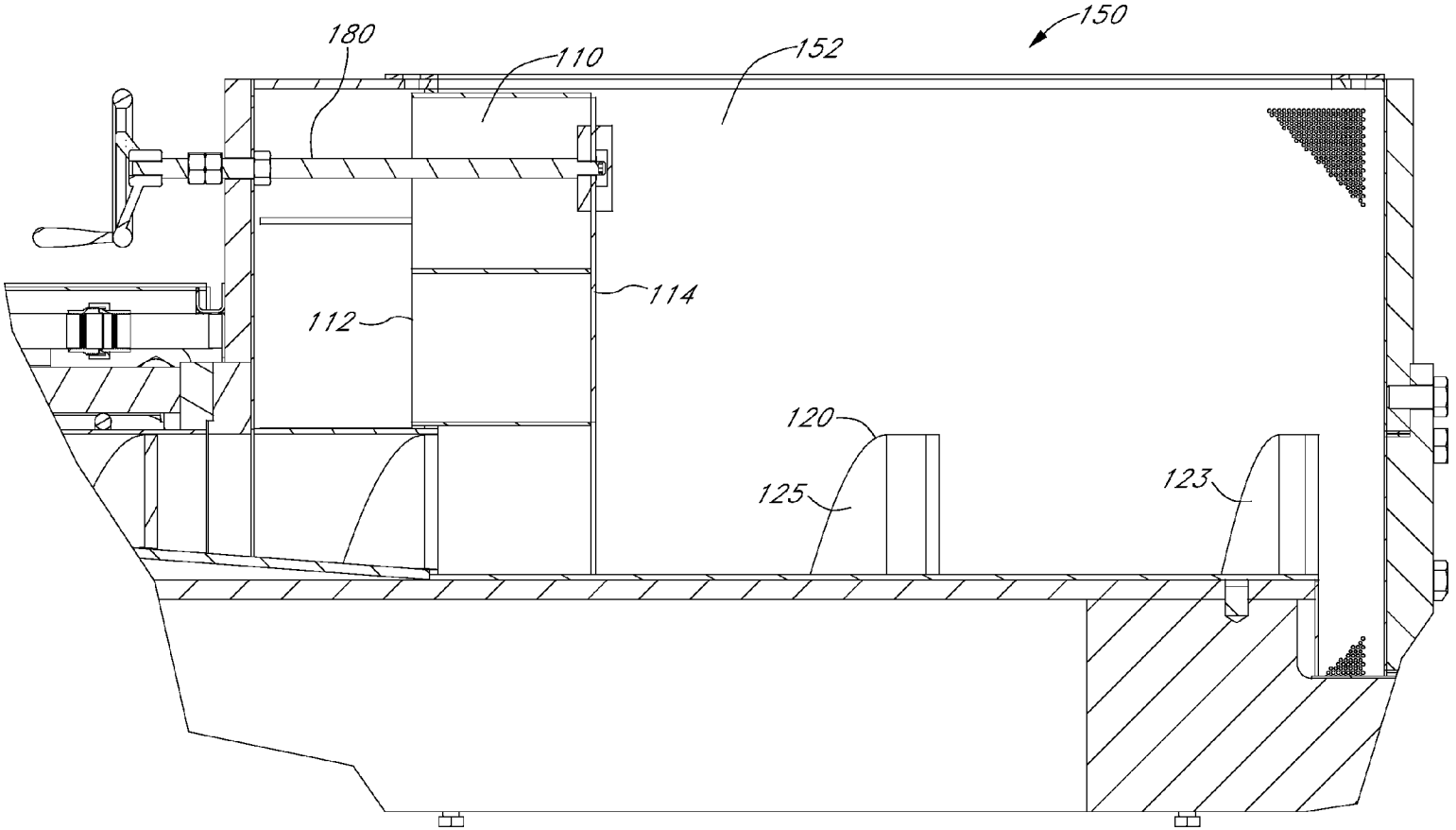
FIG. 5B is an enlarged cross section of the inlet hopper of the screw press of FIG. 4 showing the movable shroud member of the invention in its fully extended position.
Figure 6:
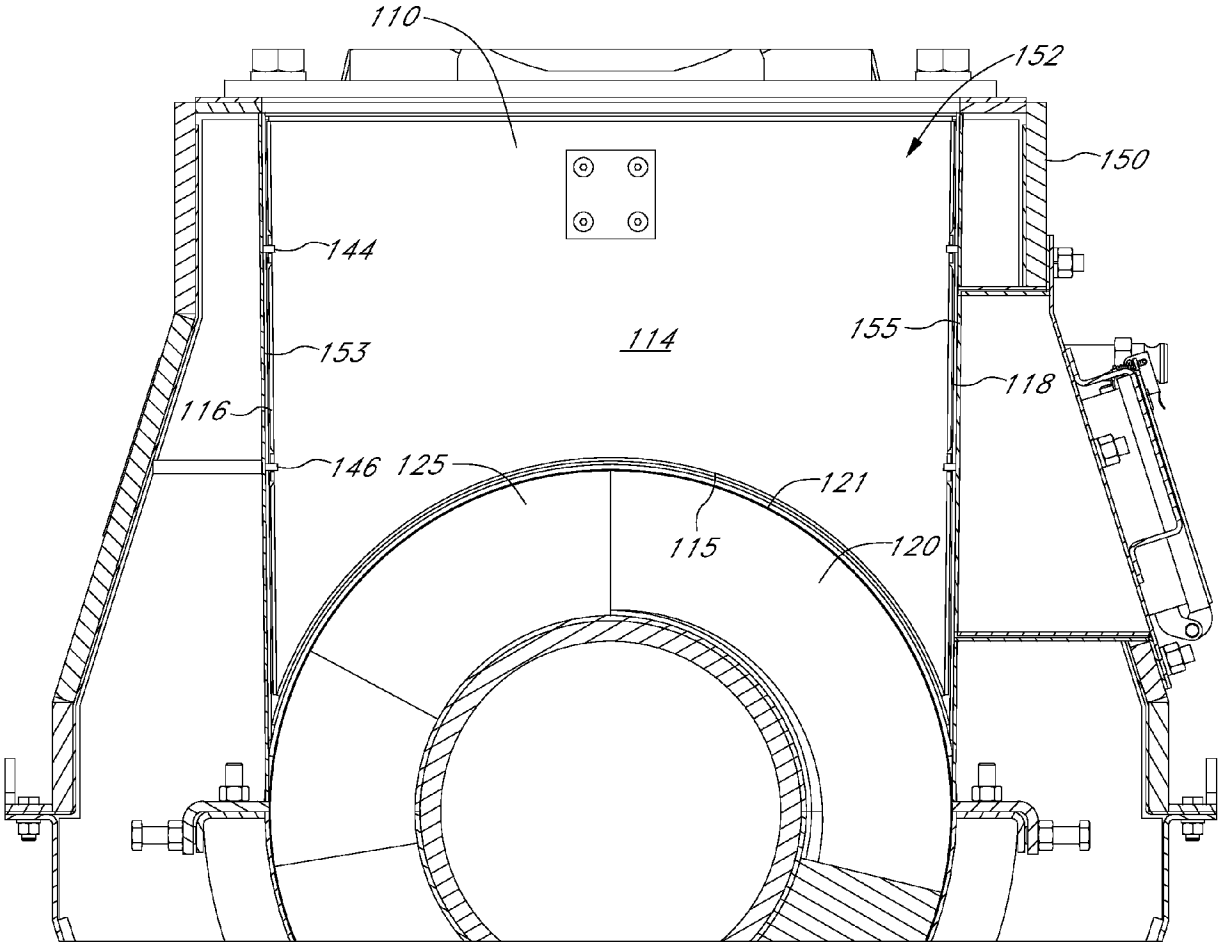
FIG. 6 is an end view in section of the intake hopper of FIG. 5 taken along vertical line 5-5 of FIG. 4.

It can be observed that shroud member 110 can be moved to any location from its fully retracted position as illustrated in FIG. 5A, adjacent the downstream end wall 157, to a fully extended position as seen in FIG. 5B, spaced away from the end wall 157 and overlying a substantial portion of the length of pressure housing feed flight 125. Therefore shroud member 110 allows the screw press 150 to compress at a ratio defined by the pitch of pressure housing feed flight 125 divided by the pitch of the final compression flight 126 or at lesser compression ratios as determined by placement of the shroud member 110 at various extensions into the intake hopper 152.

Shroud member 110 may overlie none of the pressure housing feed flight 125 or as much as approximately thirty percent of the space over pressure housing feed flight 125.

In practice, the volume displacing shroud member 110 will be used to fine tune the compression ratio of screw press 150 to maximize its compression efficiency for any batch of fibrous commodity being compressed. For instance, in the case of some fibrous materials, a nominal compression ratio of 7.5 may be appropriate but for some batches of those materials, that compression ratio may be excessive causing fiber to be extruded through the screen housing 154. In that case dewatering of the materials may be better accomplished if the ratio is reduced by, for instance, fifteen to thirty percent. The variable positioning of shroud member 110 permits the compression ratio of a given screw press to be reduced in continuous proportions and not necessarily incrementally.

Figure 7C:
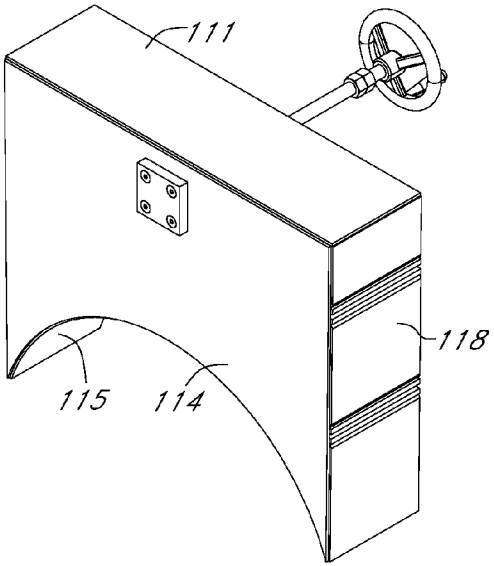
FIG. 7C is right front perspective of the shroud member isolated from the screw press of FIG. 4.
Figure 7B:
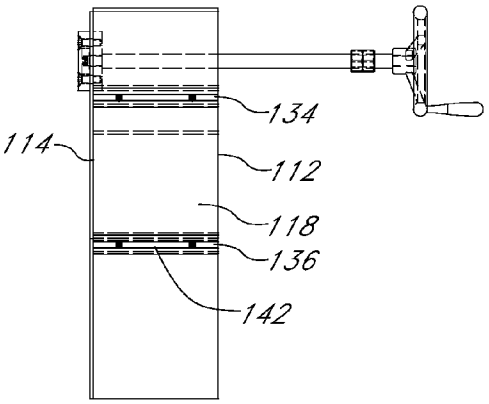
FIG. 7B is a side view of the shroud member of the invention of FIG. 4.
Figure 7A:
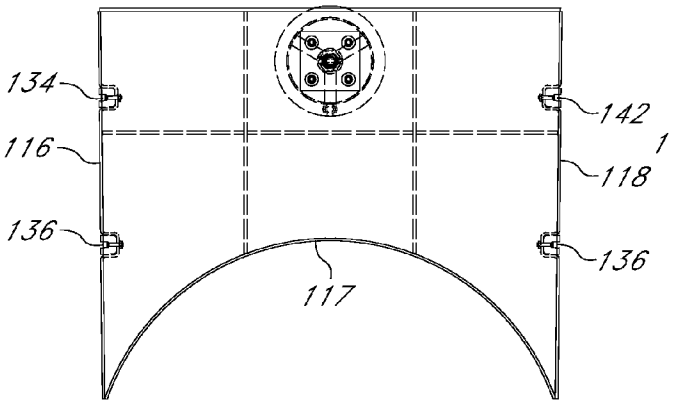
FIG. 7A is a front elevation of the shroud member of the invention of FIG. 4.

Referring particularly to FIGS. 7A, 7B, 7C, it can be observed that volume displacing shroud member 110 comprises a front wall 114, a rear wall 112, sidewalls 116, 118, top wall 111 and curved bottom wall 115. Front wall 114, sidewalls 116, 118, top wall 111, rear wall 112 and bottom all 115 define a fixed volume. Shroud member 110 may be hollow or it may be a solid mass. The curved bottom stall 115 conforms to the periphery of screw 120 and is spaced a small distance away from the outer periphery of screw 120.

Shroud member 110 includes side grooves 134, 136 on each sidewall 116, 118 which may receive rails 144, 146 which are mounted to each sidewall 153, 155 of intake hopper 152. Suitable bearing elements 142 may be installed on rails 144, 146 or within grooves 134, 136 to facilitate the sliding of the volume displacing shroud member 110 along the rails 144, 146. The location of the volume displacing shroud member 110 within intake hopper 152 may be adjusted by use of a threaded rod 180 having a hand wheel 182 thereon to facilitate its rotation. Threaded rod 180 is attached to shroud member 110 and passes through a nut 184 mounted to downstream end wall 157 so that rotation of threaded rod 180 will effect lateral movement of shroud member 110. Rotation of the hand wheel 182 allows the shroud member 110 to be moved further into intake hopper 152 or alternatively to be backed out of any blockage of the pressure housing feed flight 125.

Figure 8:
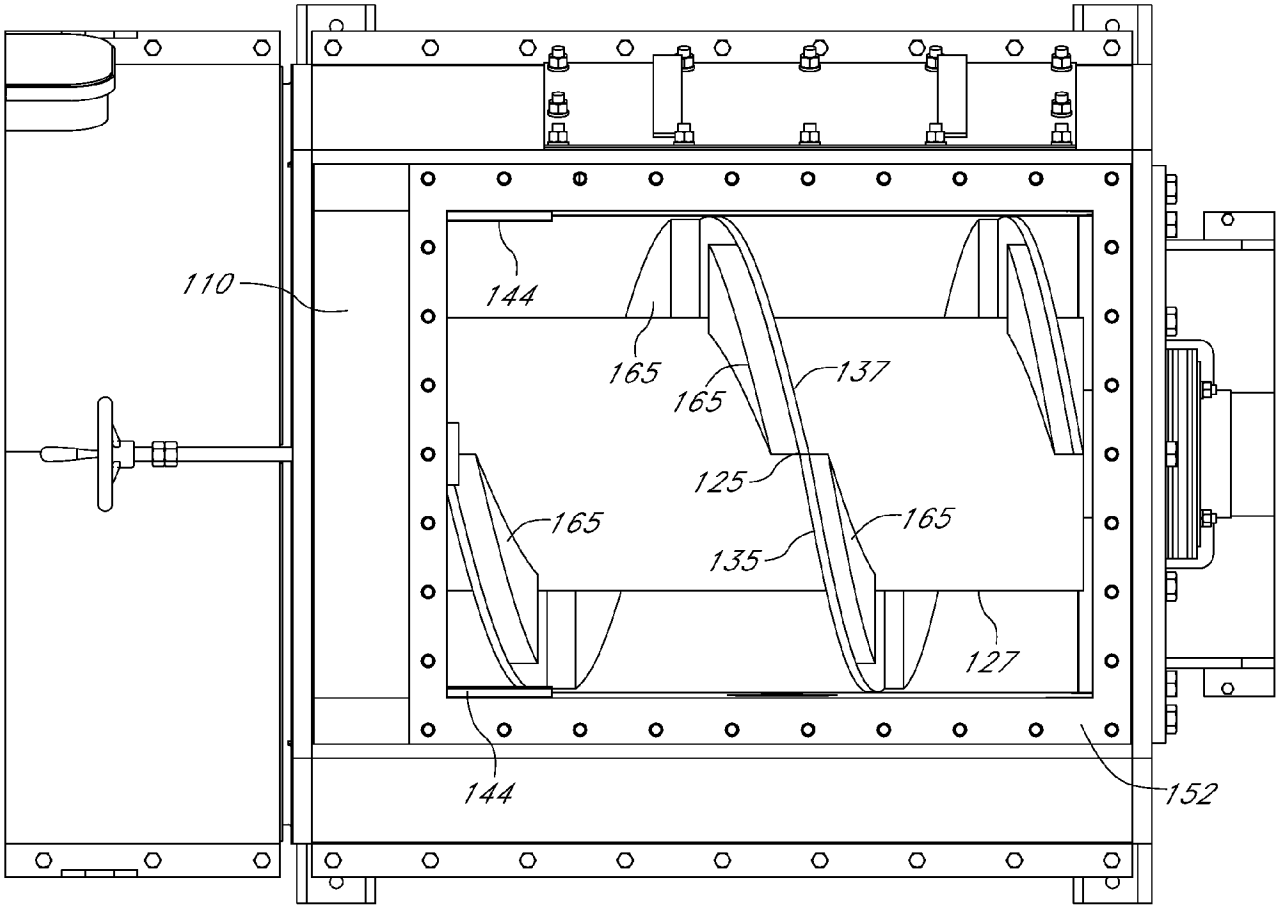
FIG. 8 is a top view of the intake hopper of a screw press showing block elements attached to the pressure housing feed flight of the screw press.

Referring now particularly to FIG. 8, a top view of the intake hopper 152 of a screw press 150 is shown, the pressure housing feed flight 125 having a third preferred embodiment of the invention attached thereto in the form of block elements 165. Block elements 165 are removably attached along the pressure housing feed flight 125 by bolt attachment to the flight 125. Block elements 165 may be elongated and may be constructed of suitable rugged materials such as stainless steel or tough polymers. In the embodiment of the invention shown in FIG. 8, block elements 165 are illustrated as ultra high molecular weight polyethylene or acetal which is extremely robust and resistive to erosion. Block elements 165 may be any shape but may be plates shaped to conform to the helical surfaces 135, 137 of the pressure housing feed flight 125. Bolts or other suitable fasteners may be employed to retain block elements 165 to pressure housing feed flight 125 such that the block elements 165 may be removed or supplanted by larger or thicker block elements 165 as needed to adjust the compression ratio of the screw press 150. Block elements 165 may be used singly or in plural, depending on the portion of the intake volume of the pressure housing feed flight 125 that is desired to be filled with the block elements 165. The installation of block elements 165 reduces the volume of commodity which can enter the pressure housing feed flight 125 and therefore reduces the compression ratio of the screw press 150 since less commodity will become compressed into the volume of the final compression flight 126 of the screw press 150.

While the present invention has been particularly shown and described with reference to exemplary embodiments thereof it should be understood by those of ordinary skill in the art that various changes, substitutions and alterations can be made herein without departing from the scope of the invention as defined by appended claims and their equivalents. The invention can be better understood by reference to the following claims. For purpose of claim interpretation, the transitional phrases "including" and "having" are intended to be synonymous with the transitional phrase "comprising".

What is claimed is:

1. Apparatus to vary a compression ratio of a screw press having a screw with wide pitch flighting at an intake region of the screw press and narrow pitch flighting at an outlet of the screw press, comprising:

a volume displacing element disposed in an intake hopper of the screw press, the volume displacing element having a curved lower end, the curved lower end conforming to a periphery of the wide pitch flighting, the screw including a feed flight disposed upstream of an entry of a cylindrical housing for the screw, the volume displacing element disposed above the feed flight, the volume displacing element being selectively moveable to span over a selected portion of the feed flight.

2. The apparatus of claim 1 wherein the volume displacing element is supported on rails on opposing sidewalls of the intake hopper, the volume displacing element includes a front wall and an opposing rear wall, the front wall spaced from the opposing rear wall and joined to the rear wall by opposing sidewalls, the volume displacing element having a top wall, volume displacing element further comprising a curved lower wall, the lower wall joining bottom ends of the sidewalls and also joining the front wall to the rear wall at respective lower ends thereof, the curved lower wall spaced apart a small distance from the periphery of the wide pitch fighting.

3. The apparatus of claim 2 wherein the volume displacing element is joined to an adjustment rod, the adjustment rod passing through an end wall of the intake hopper, the adjustment rod adapted to selectively apply forward or rearward forces to the volume displacing element to allow movement of the volume displacing element along a length of the intake hopper.

4. The apparatus of claim 1 wherein at least a first block element is mounted to the wide pitch fighting within the intake hopper.

5. The apparatus of claim 4 wherein the at least a first block element comprises a curved elongate body removably attached to a segment of a flight of the wide pitch flighting within the intake hopper, the at least a first block element abutted to a helical surface of the wide pitch flighting, the curved elongate body having a surface conforming to a helical surface of the segment of the flight of the wide pitch flighting.

6. The apparatus of claim 5 wherein the at least a first block element comprises ultra high molecular weight polyethylene.

7. The apparatus of claim 1 wherein the volume displacing element comprises a gate element, the gate element being selectively moveable to span over a desired portion of the feed flight.

8. The apparatus of claim 7 wherein an adjustment element is operative to selectively urge the gate element along the feed flight.

9. The apparatus of claim 2 wherein an adjustment element is joined to the volume displacing element to selectively cause lateral movement of the volume displacing element over the wide pitch flight.

* * * * *